US005598635A

United States Patent [19]

Saito

[11] Patent Number: 5,598,635

[45] Date of Patent: Feb. 4, 1997

[54] HYDRAULIC PUNCHER

[75] Inventor: Masayuki Saito, Tokyo, Japan

[73] Assignee: Nitto Kohki Co., Ltd., Tokyo, Japan

[21] Appl. No.: 225,327

[22] Filed: Apr. 8, 1994

[30] Foreign Application Priority Data

Apr. 28, 1993 [JP] Japan ..... 5-027423 U

[51] Int. Cl.[6] ..... B26F 1/14

[52] U.S. Cl. ..... 30/362; 30/228

[58] Field of Search ..... 30/358, 361, 362, 30/364, 228; 83/687, 698.91

[56] References Cited

U.S. PATENT DOCUMENTS

| | | | |
|---|---|---|---|
| 1,138,860 | 5/1915 | Gladwin | 30/358 |
| 3,079,824 | 3/1963 | Schott | 83/698.91 X |
| 3,205,742 | 9/1965 | Williamson | 83/698.91 X |
| 3,296,905 | 1/1967 | Killaly | 83/698.91 |
| 3,818,789 | 6/1974 | Vargo | 83/687 X |
| 3,863,341 | 2/1975 | Ramer | 30/358 |
| 3,924,330 | 12/1975 | Mitsuhashi et al. | 30/362 |
| 4,257,300 | 3/1981 | Muzik | 83/687 X |
| 4,635,437 | 1/1987 | Parton | 30/358 X |
| 5,095,618 | 3/1992 | Dacey, Jr. | 30/362 |
| 5,233,749 | 8/1993 | Saito et al. | 30/362 |
| 5,416,975 | 5/1995 | Saito et al. | 30/362 |

FOREIGN PATENT DOCUMENTS

| | | |
|---|---|---|
| 58-224029 | 12/1983 | Japan . |
| 59-101238 | 6/1984 | Japan . |

*Primary Examiner*—Rinaldi I. Rada
*Assistant Examiner*—Clark F. Dexter
*Attorney, Agent, or Firm*—Nixon & Vanderhye

[57] ABSTRACT

A hydraulic puncher includes a puncher body housing an actuator, a reciprocal ram shaft and a punch holder having one end rotatably connected to the end of the ram shaft. Punches are arranged in the other end of the punch holder. A C-shaped frame has an opening opened perpendicularly to the axis of the puncher body and one end integrally connected to the puncher body. A die holder has one end removably connected to the other end of the C-shaped frame and dies are connected to the other end of the die holder and each having holes for receiving the punches. A first connecting unit is provided for fixing the punch holder to the ram shaft so as to selectively cause the punch holder to extend toward the front side of and crosswise of the puncher. A second connecting unit is provided for fixing the die holder to the other end of the C-shaped frame so as to selectively cause the die holder to extend toward the front side of and crosswise of the puncher.

13 Claims, 4 Drawing Sheets

HYDRAULIC PUNCHER

BACKGROUND OF THE INVENTION

1. Field of the Invention

The present invention relates to a hydraulic puncher for punching a hole or holes in a workpiece such as a C channel shaped steel member.

2. Description of the Related Art

The conventional hydraulic puncher includes a puncher body having a ram shaft at its lower end, a frame formed under the puncher body, a die holder provided on the lower end of the frame, a single die provided on the die holder and an opening defined between the lower end of the puncher body and the lower end of the frame. After a workpiece has been loaded on the die on the die holder from a lateral side of the hydraulic puncher through the opening, a hole or holes are formed in the workpiece by means of a punch provided on the ram shaft.

The conventional hydraulic puncher has only a single punch provided on the ram shaft and a die holder which can only mount a single die and has no paired punchers and paired dies. Naturally, the conventional hydraulic puncher has no paired punches or paired dies which can be rotated through 90°.

When a row or rows of holes are punch-formed in an elongated workpiece, therefore, it must be moved lengthwise on the die every time a hole is formed. Thus, it takes a long time for the conventional hydraulic puncher to form the holes in such a long workpiece.

Further, it is difficult to form a hole or holes accurately and easily in an end portion of an elongated workpiece, because the die holder cannot be rotated through 90° about its own axis and thus the end of the workpiece cannot be abutted against a workpiece guide member for guiding a lateral side of the workpiece. In either case, the conventional hydraulic puncher is insufficient, leading to poor productivity. Thus, the improvement of the hydraulic puncher has been demanded in this respect.

SUMMARY OF THE INVENTION

The object of the present invention is to provide a hydraulic puncher which can be provided with a required number of punches and dies and can change the circumferential direction of a puncher holder and a die holder or a die so that holes are formed in a workpiece in the most suitable way at a high efficiency.

In order to achieve the object, the present invention provides a hydraulic puncher comprising a puncher body housing an actuator, a ram shaft provided coaxially with the axis of the puncher body in its end and operated by the actuator, a punch holder having one end rotatably connected to the end of the ram shaft, punches arranged in the other end of the punch holder at an interval equal to an interval between the adjacent holes to be formed in a workpiece, a C-shaped frame having an opening opened perpendicularly to the axis of the puncher body and having one end integrally connected to the puncher body, a workpiece guide member longitudinally adjustable toward the opening and having a contact face facing toward the opening, a die holder having one end removably connected to the other end of the C-shaped frame, a die connected to the other end of the die holder and having holes for receiving the punches, a first connecting unit for fixing the punch holder to the ram shaft at positions at which the punches fixed to the punch holder are arranged side by side and extend in parallel with the axis of the puncher body and perpendicularly to a direction directed from the intermediate portion of the C-shaped frame toward the opening, and a second connecting unit for fixing the die holder to the other end of the C-shaped frame at positions at which the dies fixed to the die holder are arranged side by side and extend in parallel with the axis of the puncher body and perpendicularly to the direction directed from the intermediate portion of the C-shaped frame toward the opening.

A punch holder having a single punch may be used in place of the punch holder having a plurality of punches and a die which is directly connected to the other end of the C-shaped frame by the second connecting unit at positions making right angles with each other with respect to the axis of the puncher body.

The hydraulic puncher is provided with one or more punches. When a plurality of punches are used, both the punch holder and die holder are connected to the ram shaft and the other end of the C-shaped frame at the positions making right angles with each other with respect to the axis of the puncher body. When a single punch is used, the die is directly connected to the other end of the C-shaped frame at positions making right angles with each other with respect to the axis S of the puncher body. Various kinds of hole forming operations can be performed with this arrangement.

DETAILED DESCRIPTION OF THE PREFERRED EMBODIMENTS

Figure 1:
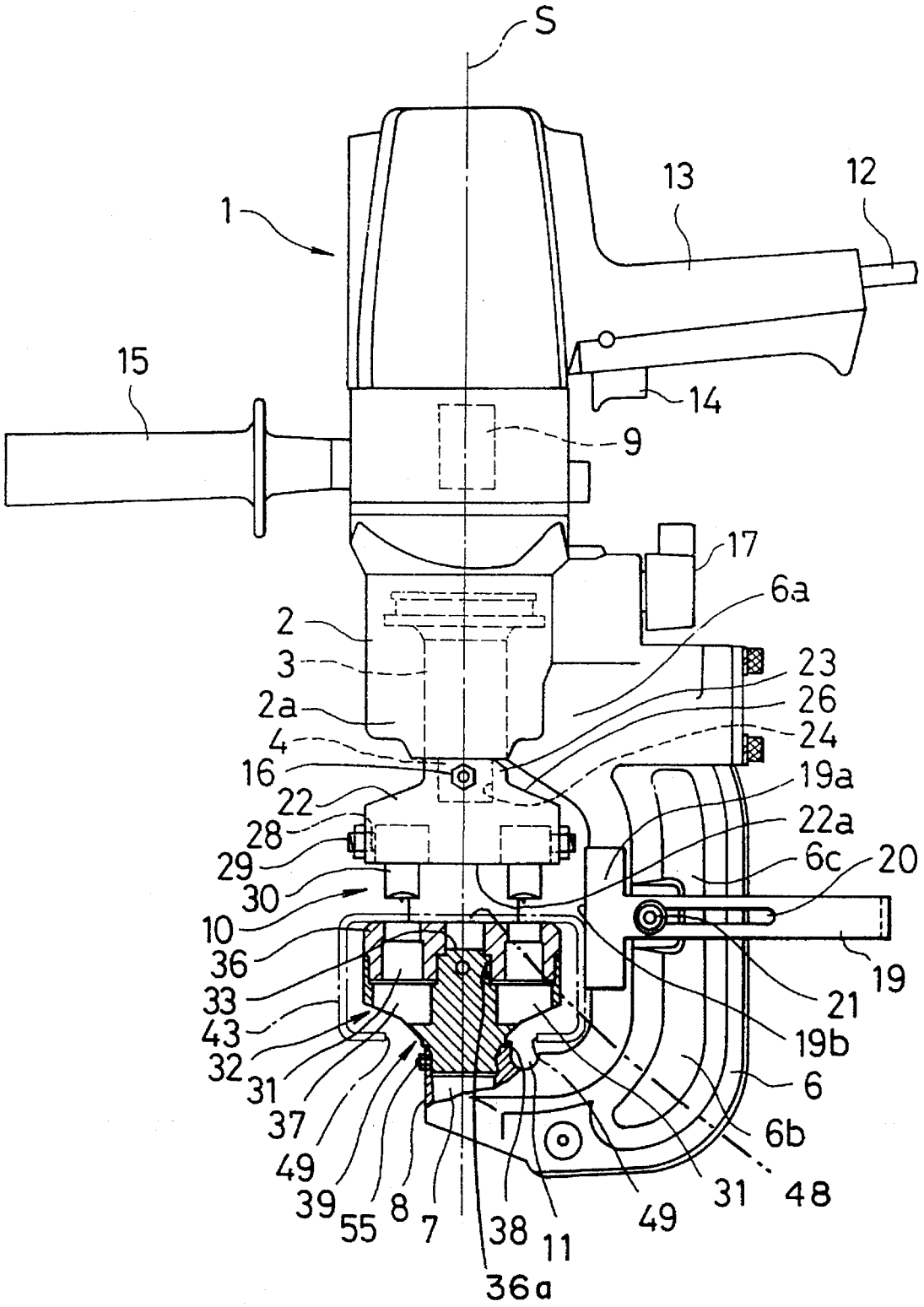
FIG. 1 is a side view of a hydraulic puncher according to an embodiment of the present invention with a die and a die holder axially cross-sectioned.

As shown in FIG. 1, a hydraulic puncher 1 according to one embodiment of the present invention includes a puncher body 2 and a C-shaped frame 6. The puncher body 2 contains an actuator 9 comprising a cylinder and a piston for reciprocating vertically in it by hydraulic pressure, and a ram shaft 3 provided in the lower end portion 2*a* of the puncher body 2 and moved vertically by means of the piston, like the conventional hydraulic puncher.

On a lateral side of the puncher body 2 is provided a main handle 13 through which electric wires 12 extend from a motor (not shown) housed in the punch body 2 to an external electric power source (not shown). The motor is switched on and off by means of a motor switch 14 provided on the undersurface of the main handle 13. On the upper portion of the C-shaped frame 6 is provided a valve switch 17 for changing over a change-over valve (not shown) in the puncher body 2 so that flow directions of hydraulic oil flowing in a hydraulic circuit.(not shown) provided in the puncher body 2 are changed. A sub-handle 15 is provided on an intermediate portion of the puncher body 2 disposed opposite to the main handle 13.

Figure 4:
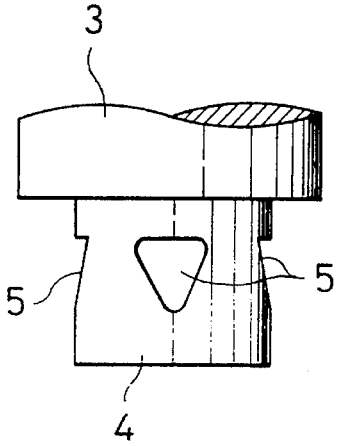
FIG. 4 is a front view of the cylindrical connecting portion of a ram shaft of the hydraulic puncher of FIGS. 1 and 3.
Figure 3:
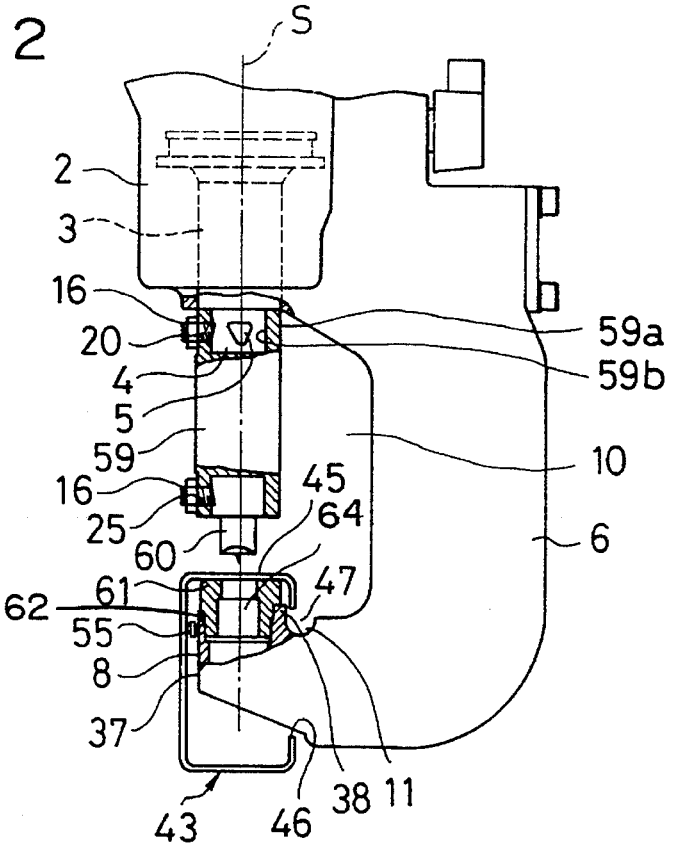
FIG. 3 is a side view of the main portion of the hydraulic puncher similar to that of FIG. 1 but provided with a punch holder having a single punch and a single die directly mounted on the lower end portion of the C-shaped frame of the hydraulic puncher, so that holes are formed in a lateral side of a workpiece.

A cylindrical connecting portion 4 having a small diameter extends downward from the lower end of the ram shaft 3. Four circumferentially equally spaced portions of an intermediate part of the connecting portion 4 incline inward and upward to form four flat faces 5, as shown in FIGS. 3 and 4.

The C-shaped frame 6 has an upper end portion 6*a* integrally connected to a side face of the lower end portion of the puncher body 2. The lower end portion of the C-shaped frame 6 faces the lower end portion 2*a* of the puncher body 2. The lower end portion of the C-shaped frame 6 forms a die-holder receiving portion 8 in which a vertical cylindrical hole 7 is formed. The structure of the die-holder receiving portion 8 will be described later in more detail with reference to FIG. 12.

The ram shaft 3, the cylindrical connecting portion 4 and the die-holder receiving portion 8 are arranged coaxially with respect to the axis S of the puncher body 2. Between the lower end portion 2*a* of the puncher body 2 and the die-holder receiving portion 8 is defined an opening 10 widely opened toward the front side of the hydraulic puncher 1. Adjacent to the upper portion of the die-holding receiving portion 8 which is at the side of the arm portion 6*b* of the C-shaped frame 6 is formed a U-shaped recess 11 for admitting an edge of a workpiece 43 on dies 36 as will be described later.

A workpiece guide member 19 having an elongated U-shape in a top plan view and a T-shape in a lateral side view sandwiches an intermediate part 6*c* of the arm portion 6*b* of the C-shaped frame 6 and extends substantially perpendicularly to the axis S of the puncher body 2. The workpiece guide member 19 has a T-head 19*a* at the side of the opening 10. The T-head 19*a* has a contact surface 19*b* facing the opening 10. The workpiece guide member 19 is adjustable longitudinally and fixed to the intermediate portion 6*c* of the arm portion 6*b* of the C-shaped frame 6 by means of a fixing bolt 21 through a longitudinally elongated hole 20 formed in the workpiece guide member 6.

Figure 5:
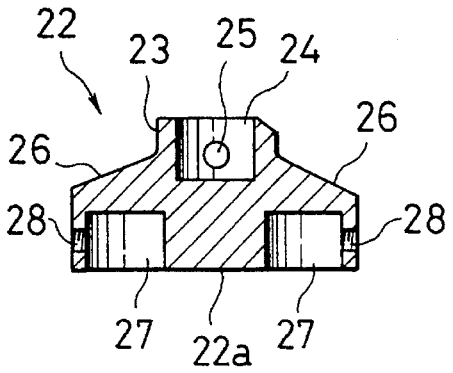
FIG. 5 is a longitudinal cross-sectional view of a punch holder of FIGS. 1 and 2.
Figure 6:
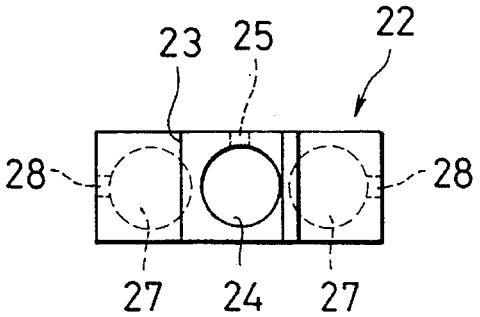
FIG. 6 is a top view of the punch holder of FIG. 5.
Figure 7:
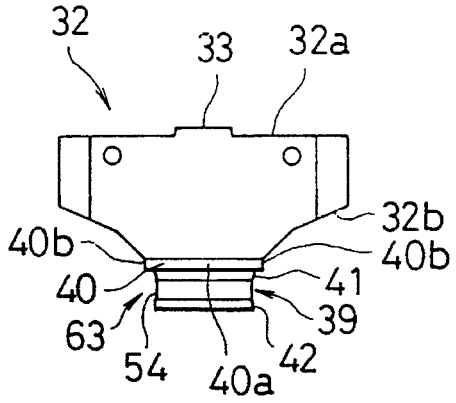
FIG. 7 is a front view of a die holder of FIGS. 1 and 2.
Figure 8:
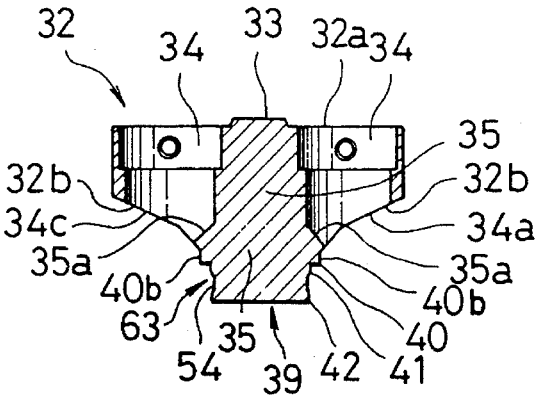
FIG. 8 is a longitudinal cross-sectional view of FIG. 7.
Figure 9:
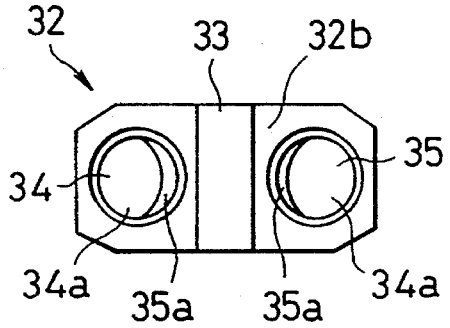
FIG. 9 is a top plan view of the die holder of FIG. 7.
Figure 10:
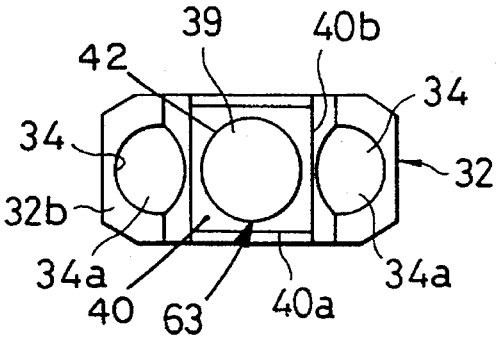
FIG. 10 is a bottom view of the die holder of FIG. 7.
Figure 11:
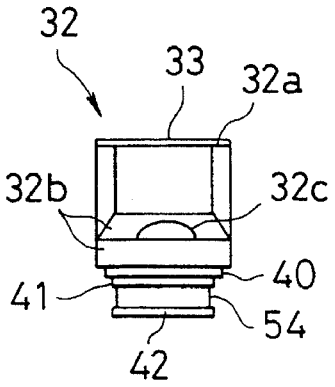
FIG. 11 is a side view of the die holder of FIG. 7.

Referring to FIGS. 5 and 6, a punch holder 22 is provided on the central portion of its upper end with a boss portion 23 having a cylindrical blind fixing hole 24 formed coaxially therewith. The fixing hole 24 has substantially the same diameter as the cylindrical connecting portion 4 of the ram shaft 3. A portion of the lateral side wall of the boss portion 23 has a threaded hole 25 opened to the fixing hole 24. The connecting portion 4 of the ram shaft 3 is inserted into the fixing hole 24 of the punch holder 22, and a fixing bolt 16 meshing with the threaded hole 25 of the boss portion 23 is tightened to have its tip engaged with the respective flat face 5 of the connecting portion of the ram shaft 3. The tip of the fixing bolt 16 also engages the stepped portion at the upper end of the flat face 5. In this way, the punch holder 22 is ensured to be coaxially fixed to the ram shaft 3.

The upper portions 26 of the punch holder 22 other than the boss portion 23 incline outward and downward so that they are prevented from abutting against the upper inner surface of the C-shaped frame 6 (FIGS. 1 and 5). Two punch mounting holes 27 are formed in the undersurface 22*a* of the punch holder 22 in such a manner that they are spaced from each other at a predetermined space and are preferably arranged symmetrically with respect to the axis S of the puncher body 2.

Two punches 30 are inserted into the corresponding punch mounting holes 27 and fixed thereto by means of fixing bolts 29 engaging threaded hole 28 formed in the lateral wall of the lower portion of the punch holder 22.

As shown in FIG. 1, 2 and 7 to 11, a die holder 32 having a generally rectangular shape as viewed from its top is provided on its upper surface 32*a* with a central rim 33 extending crosswise of the die holder 32 itself. In the die holder 32 are formed a pair of cylindrical stepped die holding holes 34 arranged symmetrical with respect to the central rim 33.

The lower parts of the die holder 32 on both sides of the central rim 33 incline inward and downward in two steps and define inclined portions 32*b*, and the solid portion 35 between the two die holding holes 34 has further inclined portions 35*a*. Openings 34*a* for ejecting slugs punched out from a workpiece 43 (FIG. 1) are defined by the lower edges of the corresponding holes 34 and the lower edges of the inclined portions 35*a*.

The lower portion of the solid part 35 constitutes an engaging section 39 for connecting the die holder 32 to the die-holder receiving portion 8. The engaging section 39 has a square plate-like engaging portion 40 starting at the inner end of the inclined portions 32*b*, a first circular flange portion 41 having a diameter smaller than the length of each side of the engaging portion 40 and formed on the undersurface thereof, a second circular flange portion 42 constituting the lower end portion of the engaging section 39. An annular groove 54 is formed between the first and second circular flange portions 41 and 42. The first and second flange portions 41 and 42 and the annular groove 54 form a flange 63. The square plate-like engaging portion 40 has a pair of parallel sides 40*a* and a pair of parallel sides 40*b* perpendicular to the parallel sides 40*a*. The central rim 33, the engaging portion 40, the first and second circular flange portions 41 and 42 and the annular groove 54 are arranged coaxially with each other.

Figure 2:
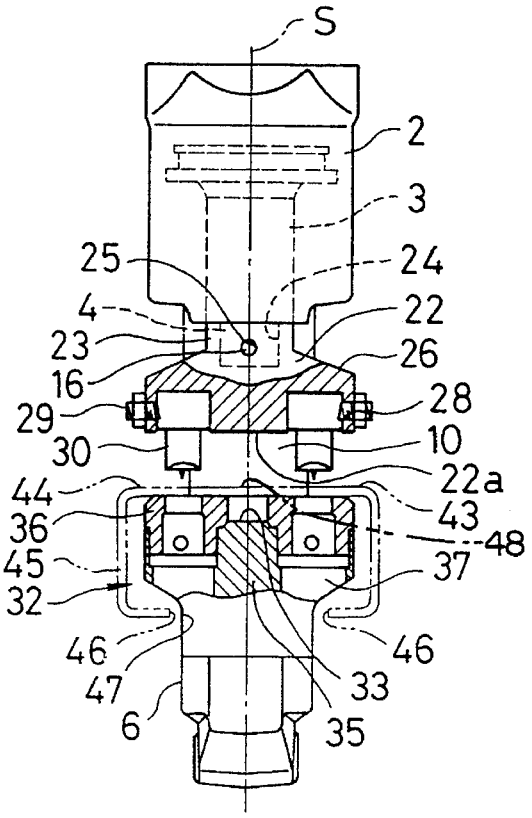
FIG. 2 is a front view of an assembly provided on the hydraulic puncher of FIG. 1 and comprising a punch holder having punches and rotatably connected to the ram shaft and a die holder carrying dies, the structure of the assembly being the same as that of FIG. 1, but being rotated through 90° from the state of FIG. 1, so that a workpiece is mounted on a die holder from the opening side with an end of the workpiece abutted against the contact face of the workpiece guide member.

As shown in FIGS. 1 and 2, dies 36 each having a punch hole 31 are placed in the corresponding die holding holes 34 (see FIGS. 8 to 10) of the die holder 32 formed with its central stepped holes 37. The stepped portion 36*a* of the outer peripheral wall of each die 36 is received by the respective upper surface 32*a* of the die holder 32.

Referring to FIGS. 1 to 3 and 12, the upper portion of the die-holder receiving portion 8 of the C-shaped frame 6 has a substantially rectangular horizontal cross section. The stepped vertical hole 7 formed in the die-holder receiving portion 8 has an upper cylindrical hole portion 7*a* having the same diameter as the diameters of the first and second circular flanges 41 and 42 and a depth slightly larger than or the same as the height of the engaging section 39 of the die holder 32. The stepped vertical hole 7 has a lower cylindrical hole portion 7*b* contiguous to and coaxial with the upper cylindrical hole portion 7*a* and having a diameter smaller than that of the upper cylindrical hole portion 7*a*.

On the edge portions of the upper surface of the die-holder receiving portion 8 which is at the side of the arm portion 6*b* of the C-shaped frame 6 is formed a die-holder positioning rim 38 extending perpendicularly to the axis S of the puncher body 2 and the workpiece guide member 19. The distance between the upper edge of the upper hole portion 7*a* of the die-holder receiving portion 8 and the front face 38*a* of the die-holder positioning rim 38 is slightly larger than the distance between each of the sides 40*a* and 40*b* of the square engaging portion 40 and the lateral side of the first circular flange portion 41. When the engaging section 39 of the die holder 32 is fitted in the die-holder receiving portion 8, the front face 38*a* of the rim 38 faces the corresponding side face 40*a* or 40*b* of the square engaging portion 40 of the die holder 32 with a small gap 58 disposed therebetween.

Figure 12:
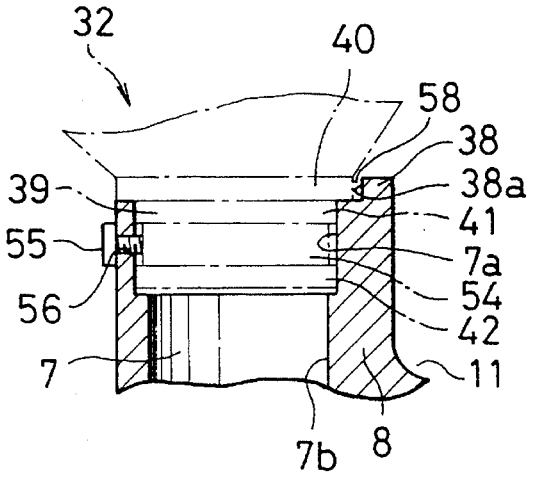
FIG. 12 is a longitudinal cross-sectional view of the die-holding receiving portion of the C-shaped frame of FIGS. 1 to 3.

As shown in FIG. 12, a bolt 55 engages a threaded hole 56 formed in a portion of the lateral wall of the die-holder receiving portion 8 which portion faces the annular groove 54 of the engaging section 39 of the die holder 32 when the engaging section 39 is set in the die-holder receiving portion 8 of the C-shaped frame 6.

The operation of the hydraulic punch 1 will be described.

Figure 13:
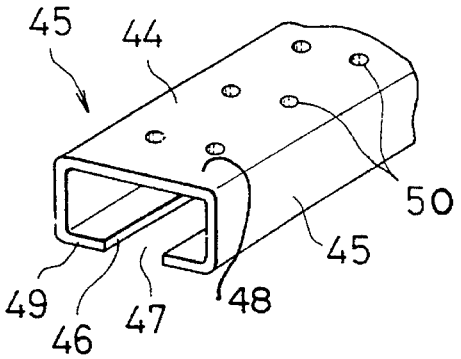
FIG. 13 is a perspective view of a workpiece which is formed with two rows of holes along the workpiece.

With reference to FIGS. 1, 4 and 13, the punch holder 22 after having been provided with two punches 30 is mounted on the ram shaft 3 by inserting the connecting portion 4 of the ram shaft 3 into the fixing hole 24 of the punch holder 22. The holder 22 is placed so that the punches 30 are arranged side by side and extending in parallel with the axis S of the punch body 2 and perpendicularly to the longitudinal direction of the workpiece guide member 19. The fixing bolt 16 is tightened to have its tip contacted with the corresponding flat face 5 on the connecting portion 4 of the ram shaft 3. The tip of the fixing bolt 16 also engages the stepped portion at the upper end of the flat 5. In this way, the punch holder 22 is fixed to the ram shaft 3 with the punches 30 arranged side by side and extending in parallel with the axis S of the punch body 2 and perpendicularly to the longitudinal direction of the workpiece guide piece 19.

Two dies 36 are fitted into the die holding holes 34 and fixed thereto. Then, the engaging section 39 of the die holder 32 is fitted into the vertical cylindrical hole 7 of the die-holder receiving portion 8 of the C-shaped frame 6.

The die holder 32 is mounted on the die-holding receiving portion 8 with the dies 36 arranged and extending in parallel with the axis S of the punch body 2 and perpendicularly to the longitudinal direction of the workpiece guide member 19, in such a way that one of the sides 40*b* at the longitudinal side ends of the die holders 32 faces the front face 38*a* of the die holder positioning rim 38. On the die-holder receiving portion 8 of the C-shaped frame 6, the die holder 32 can be swung around the axis S of the puncher body 2 within the range of the gap 58 between the upper edge of the upper hole portion 7*a* and the front face 38*a* of the die positioning rim 38 of the die-holder receiving portion 8 of the C-shaped frame 6, so that the dies 36 will align with the corresponding punches 30. The bolt 55 is tightened to have its tip engaged with the annular groove 54, and the die holder 32 is fixed to the die-holder receiving portion 8 of the C-shaped frame 6.

The workpiece guide member 19 is adjusted lengthwise so that a C-shaped workpiece 43 such as a C channel shape steel member can be placed on the right place of the dies 36 at which holes will be punch-formed with a lateral side of the workpiece 43 contacted with the front face 19*b* of the T-head 19*a* of the workpiece guide member 19.

A C-shaped workpiece 43 such as a C channel shape steel member is inserted into the opening 10 from a lateral side of the hydraulic puncher 1 in such a manner that the workpiece 43 extends crosswise of the hydraulic puncher 1, i.e., in a direction perpendicular to the axis S of the puncher body 2 and the longitudinal direction of the workpiece guide member 19.

A part of the main portion 44 of the workpiece 43 which is to be formed with holes is placed on the dies 36, with a lateral side 45 of the workpiece 43 contacted with the contact surface 19*b* of the T-head 19*a* of the workpiece member 19 and with the die-holder receiving portion 8 interposed between the facing edges 46 of the workpiece 43 between which a longitudinal groove 47 is defined. Then, the punch holder 22, together with the ram shaft 3, is quickly driven downward to the workpiece 43 to punch-form two holes 50. After having punched the two holes 50, the workpiece 43 is moved lengthwise by a predetermined length at which the next holes 50 are to be formed. This process is repeated until the last holes are formed in each workpiece 43. The result is shown in FIG. 13. Since two holes 50 are formed every time the punching operation is performed, productivity of hole formation is improved as compared with that of the conventional hydraulic puncher.

Figure 14:
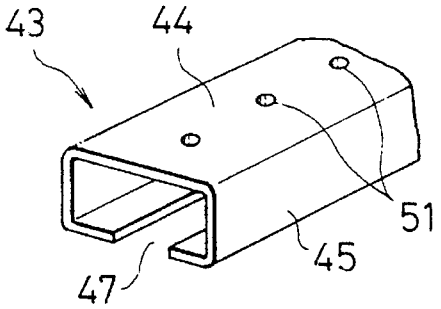
FIG. 14 is a perspective view of a workpiece which is formed with a row of holes along the workpiece.

When the puncher holder 22 is fixed to the ram shaft 3 and the die holder 32 is fixed to the die-holder receiving portion 8 of the C-shaped frame 6 in a state in which they take the positions at which they are rotated through 90° from the above-mentioned state. Then, a row of holes 51 are punch-formed as shown in FIG. 14, wherein two adjacent holes 51 are formed every time the punching operation is carried out, improving the productivity of hole formation.

Figure 15:
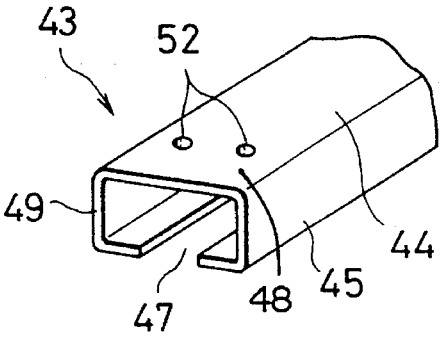
FIG. 15 is a perspective view of a workpiece which is formed with holes in its end portion.

With reference to FIGS. 2 and 15, a C-shaped workpiece 43 such as a C channel shape steel member is inserted from the front end of the opening 10 of the C-shaped frame 6 to mount an end portion 48 of the workpiece 43 on the dies 36 in such a manner that the workpiece 43 extends in the longitudinal direction of the workpiece guide member 19.

The workpiece guide member 19 is adjusted lengthwise so that the end portion 48 of the workpiece 43 can be placed on the dies 36 at which holes will be punch-formed when the end 49 of the end portion 48 of the workpiece 43 is in contact with the front face 19*b* of the T-head 19*a* of the workpiece guide member 19. Then, the ram shaft 3 is quickly lowered and two holes 52 are formed by the punches 20 precisely.

The hydraulic puncher as shown in FIG. 3 uses a punch holder 59 having an lower end to which a single punch 60 is fixed, and a die 61 directly mounted on the die-holder receiving portion 8 of the frame 6, without using a die holder.

The upper end portion 59*a* of the punch holder 59 has a cylindrical hole 59*b* in which the cylindrical connecting portion 4 of the ram shaft 3 is inserted. A fixing bolt 16 engaging a threaded hole 28 formed in the lateral wall of the upper portion 59*a* of the punch holder 59 is tightened with its tip engaging one of the flat faces 5 of the connecting portion 4 of the ram shaft 3, whereby the punch holder 59 is fixed to the ram shaft 3. The C-shaped frame 6 is provided with a workpiece guide member similar to the workpiece guide member 19 as shown in FIG. 1 but is omitted from FIG. 3 for simplicity.

Figure 16:
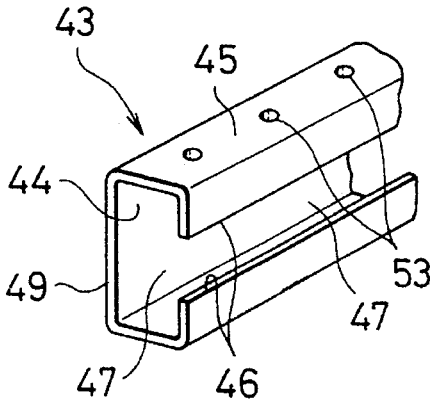
FIG. 16 is a perspective view of a workpiece which is formed with holes in a lateral side of a workpiece.

The die 61 has a hole 64 for receiving the punch 60 and is provided at its lower end with an engaging section 62 having the same structure and function as the engaging section 39 of the embodiment of FIGS. 1, 2 and 4. When the die 61 is set to extend in the longitudinal direction of the workpiece Guide member 19, the workpiece 43 is inserted crosswise of the hydraulic puncher 1 and is located on the die 61 with one side 45 placed on the die 61 and with the longitudinal Groove 47 directed toward the C-shaped frame 6, as shown in FIG. 3. In this arrangement, holes 53 are formed one by one along the workpiece 43 in its lateral side 45 as shown in FIG. 16.

When the die 61 is set in a state rotated through 90° around the axis S of the puncher body 2, the workpiece 43 is inserted into the opening 10 from its front side and an end portion of the workpiece 43 is placed on the die 61 to form a hole in the end portion of the workpiece 43.

The punch holder 22 may be provided with three or more punches arranged side by side and the die holder 32 may also be provided with the same number of dies arranged side by side, when required.

What is claimed is:

1. A hydraulic puncher which comprises:

a puncher body having one end portion and an axis;

a longitudinally movable ram shaft provided coaxially with said axis in said one end portion of said puncher body and having one end projecting therefrom;

a punch holder having two ends, one end being connected to said one end of said ram shaft rotatably about said axis;

a plurality of punches arranged side by side in the other end of said punch holder at a predetermined interval equal to a desired interval of adjacent holes to be formed in a workpiece;

a C-shaped frame having an opening opened perpendicularly to said axis and having two ends, one end being integrally connected to said puncher body and the other end facing the other end of said punch holder so as to be coaxial with said axis, said C-shaped frame having an intermediate portion;

a die holder having two ends, one end being removably connected to said other end of said C-shaped frame;

a plurality of dies connected to the other end of said die holder and each having a hole for receiving one of said punches;

first connecting means for fixing said punch holder to said ram shaft at positions at which said punches fixed to said punch holder are arranged side by side and extend in parallel with said axis of said punch body; and second connecting means for fixing said die holder to said other end of said C-shaped frame at positions at which said dies fixed to said die holder are arranged side by side and directed so as to align with corresponding ones of said punches; and wherein said other end of said C-shaped frame comprises a die-holder receiving portion having edge portions, a cylindrical hole formed in said die holder receiving portion and opened toward said ram shaft and coaxial therewith, and a die holder positioning rim formed on one of said edge portions of said die-holder receiving portion which is disposed on a side of said die holder receiving portion which is proximal to said intermediate portion of said C-shaped frame, said die holder positioning rim extending perpendicularly to said axis and directed toward said opening; and said die holder having an engaging section comprising a plate-like engaging portion which is seated next to and is engageable with said die holder positioning rim, and a circular flange extending from said engaging section and fitted into said cylindrical hole in said die holder receiving portion.

2. A hydraulic puncher according to claim 1, wherein each of said edge portions of said die-holder receiving portion of said C-shaped frame and said engaging section of said die holder and formed into a square shape.

3. A hydraulic puncher according to claim 1, wherein a gap is provided between said die holder positioning rim and said plate-like engaging portion of said die holder which is fitted in said die-holder receiving portion.

4. A hydraulic puncher according to claim 3, wherein said circular flange has an annular groove, and said second connecting means comprises a bolt threadably engaged with said die-holder receiving portion of said C-shaped frame and said annular groove.

5. A hydraulic puncher according to claim 4, wherein said ram shaft is provided on said one end thereof with a cylindrical connecting portion having flat faces spaced at a predetermined circumferential interval, said punch holder is provided on said one end thereof with a boss portion having a cylindrical fixing hole receiving said cylindrical connecting portion of said ram shaft, and said first connecting means comprises a fixing bolt threadably engaged with said boss portion and one of said flat faces.

6. A hydraulic puncher according to claim 5, wherein each of said flat faces inclines outwardly toward said one end of said ram shaft.

7. A hydraulic puncher according to claim 1, further comprising a workpiece guide member extending in a direction perpendicular to said axis, directed from said intermediate portion of said C-shaped frame toward said opening and longitudinally adjustably provided on said intermediate portion of said C-shaped frame.

8. A hydraulic puncher which comprises:

a puncher body having one end portion and an axis;

a longitudinally movable ram shaft provided coaxially with said axis in said one end portion of said puncher body and having one end projecting therefrom;

a punch holder having two ends, one end being connected to said one end of said ram shaft rotatably about said axis;

a punch connected to the other end of said punch holder;

a C-shaped frame having an opening opened perpendicularly to said axis and having two ends, one end being integrally connected to said puncher body and the other end facing the other end of said punch holder so as to be coaxial with said axis, said C-shaped frame having an intermediate portion;

a die holder having two ends, one end being removably connected to said other end of said C-shaped frame;

a die connected to the other end of said die holder and having a hole for receiving said punch;

first connecting means for fixing said punch holder to said ram shaft at a position at which said punch fixed to said punch holder extends in parallel with said axis of said punch body; and second connecting means for fixing said die holder to said other end of said C-shaped frame at a position at which said die fixed to said die holder aligns with said punch; and wherein said other end of said C-shaped frame comprises a die-holder receiving portion having edge portions, a cylindrical hole formed in said die holder receiving portion and opened toward said ram shaft and coaxial therewith, and a die holder positioning rim formed on one of said edge portions of said die-holder receiving portion which is disposed on a side of said die holder receiving portion which is proximal to said intermediate portion of said C-shaped frame, said die holder positioning rim extending perpendicularly to said axis and directed toward said opening; and said die holder having an engaging section comprising a plate-like engaging portion which is seated next to and is engageable with said die holder positioning rim, and a circular flange extending from said engaging section and fitted into said cylindrical hole in said die holder receiving portion.

9. A hydraulic puncher according to claim 8, wherein each of said edge portions of said die-holder receiving portion of said C-shaped frame and said engaging section of said die holder are formed into a square shape.

10. A hydraulic puncher according to claim 8, wherein a gap is provided between said die holder positioning rim and said plate-like engaging portion of said die holder.

11. A hydraulic puncher according to claim 10, wherein said circular flange has an annular groove, and said second connecting means comprises a bolt threadably engaged with said die-holder receiving portion of said C-shaped frame and said annular groove.

12. A hydraulic puncher which comprises:

a puncher body having one end portion and an axis;

a longitudinally movable ram shaft provided coaxially with said axis in said one end portion of said puncher body and having one end projecting therefrom, said ram shaft being provided on said one end with a cylindrical connecting portion having four flats circumferentially spaced at equal intervals;

a punch holder having two ends, and a boss portion formed on one of said two ends of said punch holder and formed with a cylindrical fixing hole receiving said cylindrical connecting portion of said ram shaft;

a punch fixedly connected to the other end of said punch holder;

a C-shaped frame having an opening opened perpendicularly to said axis and having two ends, one end being integrally connected to said puncher body and the other end facing the other end of said punch holder so as to be coaxial with said axis, said C-shaped frame having an intermediate portion;

a die connected to said other end of said C-shaped frame and having a punch hole receiving said punch;

a fixing bolt threadedly engaged with said boss portion and one of said flat faces, for fixing said punch holder to said ram shaft at a position at which said punch fixed to said punch holder is coaxial with said axis of said punch holder; and a bolt threadedly engaged with said other end of said C-shaped frame and said die, for fixing said die to said other end of said C-shaped frame at a position at which said die aligns with said punch;

wherein said other end of said C-shaped frame comprises edge portions, a hole opened toward said ram shaft and coaxial therewith, and a die holder positioning rim formed on one of said edge portions of said other end of said C-shaped frame which is disposed on a side of said other end of said C-shaped frame which is proximal to said intermediate portion of said C-shaped frame, said die holder positioning rim extending perpendicularly to said axis and directed toward said opening; and said die holder having an engaging section comprising a plate-like engaging portion which is seated next to and is engageable with said die holder positioning rim, and a circular flange extending from said engaging section and fitted into said hole in said die.

13. A hydraulic puncher according to claim 12, wherein each of said flat faces inclines outwardly toward said one end of said ram shaft.

* * * * *